US008085029B2

(12) United States Patent
Dobkin

(10) Patent No.: US 8,085,029 B2
(45) Date of Patent: Dec. 27, 2011

(54) BANDGAP VOLTAGE AND CURRENT REFERENCE

(75) Inventor: Robert C. Dobkin, Monte Sereno, CA (US)

(73) Assignee: Linear Technology Corporation, Milpitas, CA (US)

( * ) Notice: Subject to any disclaimer, the term of this patent is extended or adjusted under 35 U.S.C. 154(b) by 369 days.

(21) Appl. No.: 11/731,279

(22) Filed: Mar. 30, 2007

(65) Prior Publication Data

US 2008/0238400 A1 Oct. 2, 2008

(51) Int. Cl.
*G05F 3/16* (2006.01)
*G05F 3/20* (2006.01)

(52) U.S. Cl. ..... 323/314; 323/315

(58) Field of Classification Search ..... 323/313, 323/273, 311, 312, 314, 315, 316, 907; 327/539
See application file for complete search history.

(56) References Cited

U.S. PATENT DOCUMENTS

| | | | | |
|---|---|---|---|---|
| 4,656,415 | A * | 4/1987 | Draxelmayr | 323/314 |
| 5,629,612 | A | 5/1997 | Schaffer | |
| 6,087,820 | A * | 7/2000 | Houghton et al. | 323/315 |
| 6,426,669 | B1 * | 7/2002 | Friedman et al. | 327/539 |
| 6,693,485 | B1 * | 2/2004 | Huber | 327/563 |
| 7,321,225 | B2 * | 1/2008 | Garlapati et al. | 323/313 |
| 2003/0006820 | A1 * | 1/2003 | Enriquez | 327/322 |
| 2006/0043957 | A1 * | 3/2006 | Carvalho | 323/313 |
| 2008/0094131 | A1 * | 4/2008 | Pertijs et al. | 327/542 |

FOREIGN PATENT DOCUMENTS

| | | |
|---|---|---|
| EP | 0 687 967 A1 | 12/1995 |
| JP | 58-172722 | 10/1983 |

OTHER PUBLICATIONS

Avoinne, C., et al, *Second-order compensated bandgap reference with convex correction*, Electronics Letter, vol. 41, No. 5, Mar. 3, 2005, 2 pgs.

Wildar, Robert J., *Low Voltage Techniques*, IEEE Journal of Solid-State Circuits, vol. SC-13, No. 6, Dec. 1978, pp. 838-846.

Gunawan, Made et al., *A Curvature-Corrected Low-Voltage Bandgap Reference*, IEEE Journal of Solid-State Circuits, vol. 28, No. 6, Jun. 1993, pp. 667-670.

*The Best of Bob Pease: The Design of Band-Gap Reference Circuits: Trials and Tribulations*, Sep. 2006, 7 pgs.

LM10 Operational Amplifier and Voltage Reference, National Semiconductor, Aug. 2000, pp. 1-25.

International Preliminary Report on Patentability issued in corresponding International Application No. PCT/US2007/018298, mailed on Apr. 14, 2008.

Piero Malcovati, et al., Curvature-Compensated BiCMOS Bandgap with 1-V Supply Voltage, IEEE Journal of Solid-State Circuits, vol. 36, No. 7, Jul. 2001, pp. 1076-1081.

* cited by examiner

*Primary Examiner* — Harry Behm
*Assistant Examiner* — Matthew Grubb
(74) *Attorney, Agent, or Firm* — McDermott Will & Emery LLP

(57) ABSTRACT

Circuits and methods that improve the performance of reference circuits are provided. A reference generator circuit maintains a substantially constant output current over an extended temperature for use as a reference. Output current fluctuations caused by a poorly specified power source or process variations are minimized or eliminated.

32 Claims, 5 Drawing Sheets

BANDGAP VOLTAGE AND CURRENT REFERENCE

BACKGROUND OF THE INVENTION

This invention relates to electronic reference circuitry. More particularly, the invention relates to bandgap references that provide a substantially constant output current which may be used as voltage or current references.

Bandgap voltage references have been widely used in electronic applications for many years. The purpose of a bandgap voltage reference is to provide a substantially constant and stable voltage over a fairly wide temperature range. Such references form a vital part of numerous commonly used circuits such as analog-to-digital and digital-to-analog converters, phase-locked loops, voltage regulators, comparison circuits, etc.

The basic principle behind the bandgap reference is the well-known voltage drop associated with certain semiconductor junctions. For example, a silicon p-n junction such as the emitter-base junction bipolar transistor may have a forward conduction characteristic (i.e., voltage drop) of about 0.6 volts. It is possible to construct a basic voltage reference circuit based on this known physical conduction property. For example, one or more such p-n junctions may be connected in series to form a voltage reference circuit that has a predetermined and stable output voltage. For example, connecting two silicon diodes in series provides a regulated 1.2 volt output, three silicon diodes connected in series provide a regulated 1.8 volt output, etc.

Although the configuration proposed above does provide a stable reference voltage, it is well known that the forward conduction characteristics of semiconductor junctions change with temperature. As temperature rises, the forward voltage drop is altered, resulting in a negative temperature coefficient, which undesirably changes the output voltage. Similarly, as temperature falls, the forward voltage is also altered, resulting in a positive temperature coefficient, which also undesirably alters the output voltage, albeit with an opposite effect.

Improved bandgap voltage references have been proposed which employ various compensation schemes that attempt to normalize output voltage over a wide temperature range. Such bandgap reference circuits are transistor-based and operate on the principle of compensating the negative temperature coefficient of a base-emitter voltage ($V_{BE}$) of a bipolar transistor with the positive temperature coefficient of the thermal voltage, (i.e., with $V_{Thermal}=k*(T/q)$, where k is Boltzmann's constant, T is the absolute temperature in degrees Kelvin, and q is the electronic charge). In general, the negative temperature coefficient of the base-emitter voltage $V_{BE}$ is summed with the positive temperature coefficient of the thermal voltage $V_{Thermal}$, which is appropriately scaled such that the resultant summation provides a small or negligible temperature coefficient over a fairly wide temperature range.

More specifically, a reference voltage is typically obtained by combining two generated voltages having equal and opposite temperature coefficients (TC). One is the base-emitter voltage ($V_{BE}$) of a forward biased bipolar transistor $Q_{REF}$ with a TC of about −2 mV/° C. This voltage is said to be complementary to absolute temperature voltage ($V_{CTAT}$) and can be expressed as:

$$V_{CTAT}=V_{BE}(T_R)-V_{G0}-[(V_{G0}-V_{BE}(T_0))*(T/T_0)]+[(kT/q)*(n-m)*\ln\{T/T_0)] \quad (1)$$

where $V_{G0}$ is the extrapolated bandgap voltage at 0 degrees K, and n and m are process related parameters representing, respectively, the temperature variation of mobility and collector current. $T_0$ is the temperature at which $V_{BE}$ is measured, T is the Kelvin temperature, k is Boltzmann's constant, q is the charge on the electron, and $V_{BE}(T_R)$ is the base-emitter voltage at the reference temperature $T_R$.

To generate the bandgap, reference circuits typically employ two groups of transistors running at different current densities. For example, one group of transistors will typically run at about ten times the current density of the other group. This causes a 60 mV difference between the base-emitter voltages of the two groups. This difference in voltage is usually amplified by a factor of about ten and is added to the base-emitter voltage. The total of these two voltages typically adds up to about 1.22 volts, which is essentially the bandgap of silicon.

A typical prior art bandgap circuit 100 is shown in FIG. 1. Bandgap circuit 100 generally includes an NPN transistor 160 that runs at a relatively high density. NPN transistor 170 is operated at a lower density, thus the voltage at the emitter of transistor 170 is approximately 60 mV. This voltage is applied across resistor 150 and is increased by the ratio of resistor 140 to resistor 150. If the ratio is approximately ten to one, the voltage level moves up to approximately 600 mV. This voltage is added to the base-emitter voltage of NPN transistor 180, producing a total voltage of about 1.22 volts. Transistor 180 then amplifies the error signal through transistors 125 and 190, which provides enough gain to shunt regulate the output voltage between nodes V+ and V− at 1.22 volts.

Such conventional bandgap circuits however, are typically concerned with providing a substantially constant output voltage. Moreover, output voltage in conventional bandgap circuits is dependent on certain transistor conduction characteristics, current gain (i.e., beta), and therefore subject to change due to process and other variations associated with physical implementation. Moreover, the minimum output voltage of such references is about one bandgap, or 1.22 volts.

Accordingly, in view of the foregoing, it would be desirable to provide improved reference circuitry that overcomes these and other drawbacks.

SUMMARY OF THE INVENTION

It is therefore an object of the present invention to provide circuits and methods that improve the performance of electronic reference circuitry, at least in part, by providing a substantially constant output current instead of voltage and reducing or eliminating output current variance based on certain physical process characteristics.

In one embodiment of the present invention, the bandgap reference circuit is configured to provide a substantially constant output current, the bandgap reference including a reference generator circuit, the reference generator circuit including a first transistor running at a first predefined current, a second transistor running at a second predefined current, wherein the first current is substantially defined by the second current minus a third predefined current; and an output circuit coupled to the reference generator circuit that provides the substantially constant output current proportional to the second predefined current.

In another embodiment of the present invention, a bandgap reference circuit is provided that generates a substantially constant output current and includes a reference generator circuit that generates a substantially constant output current as temperature changes, an output circuit that provides the substantially constant output current based on the output current of the reference generator, and a regulator circuit coupled to the reference generator circuit and the output circuit, the regulator circuit forming a feedback loop that controls the output current of the output circuit to be substantially constant and proportional to the output current of the reference generator circuit.

Another embodiment of the present invention is directed toward a method of providing a substantially constant output current, including generating a first predefined current with a first transistor in a reference generator circuit, generating a second predefined current with a second transistor in a reference generator circuit, wherein the first predefined current is substantially defined by the second current minus a third predefined current, and providing the substantially constant output current with an output circuit based on the second predefined current.

BRIEF DESCRIPTION OF THE DRAWINGS

The above and other objects and advantages of the present invention will be apparent upon consideration of the following detailed description, taken in conjunction with the accompanying drawings, in which like reference characters refer to like parts throughout, and in which.

DETAILED DESCRIPTION OF THE INVENTION

Figure 1:
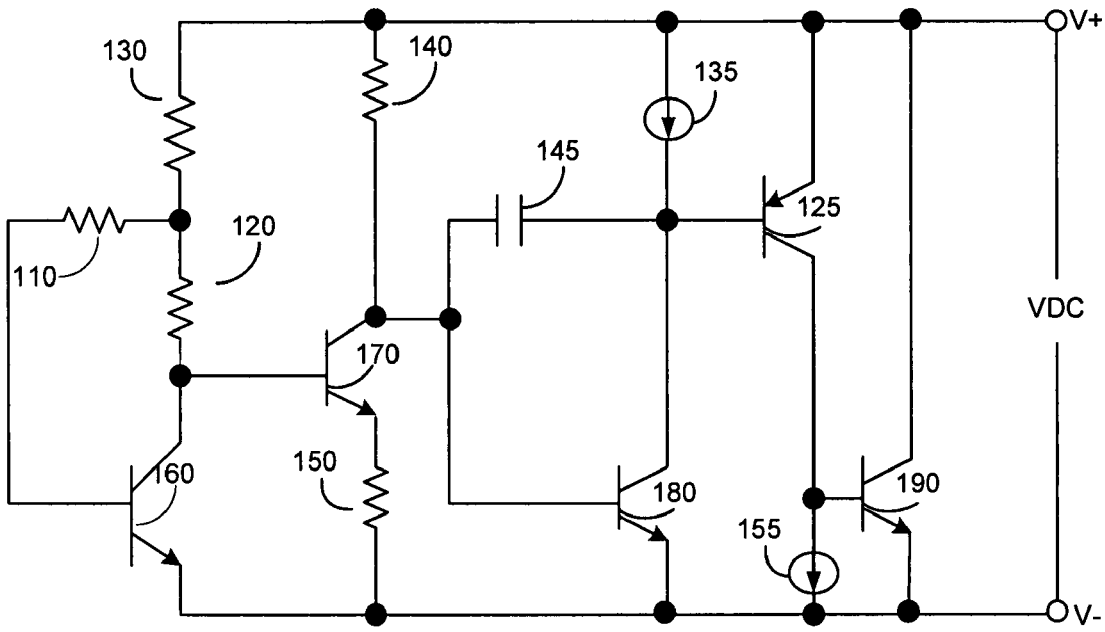
FIG. 1 PRIOR ART
FIG. 1 is a schematic diagram of a prior art bandgap reference circuit.
Figure 2:
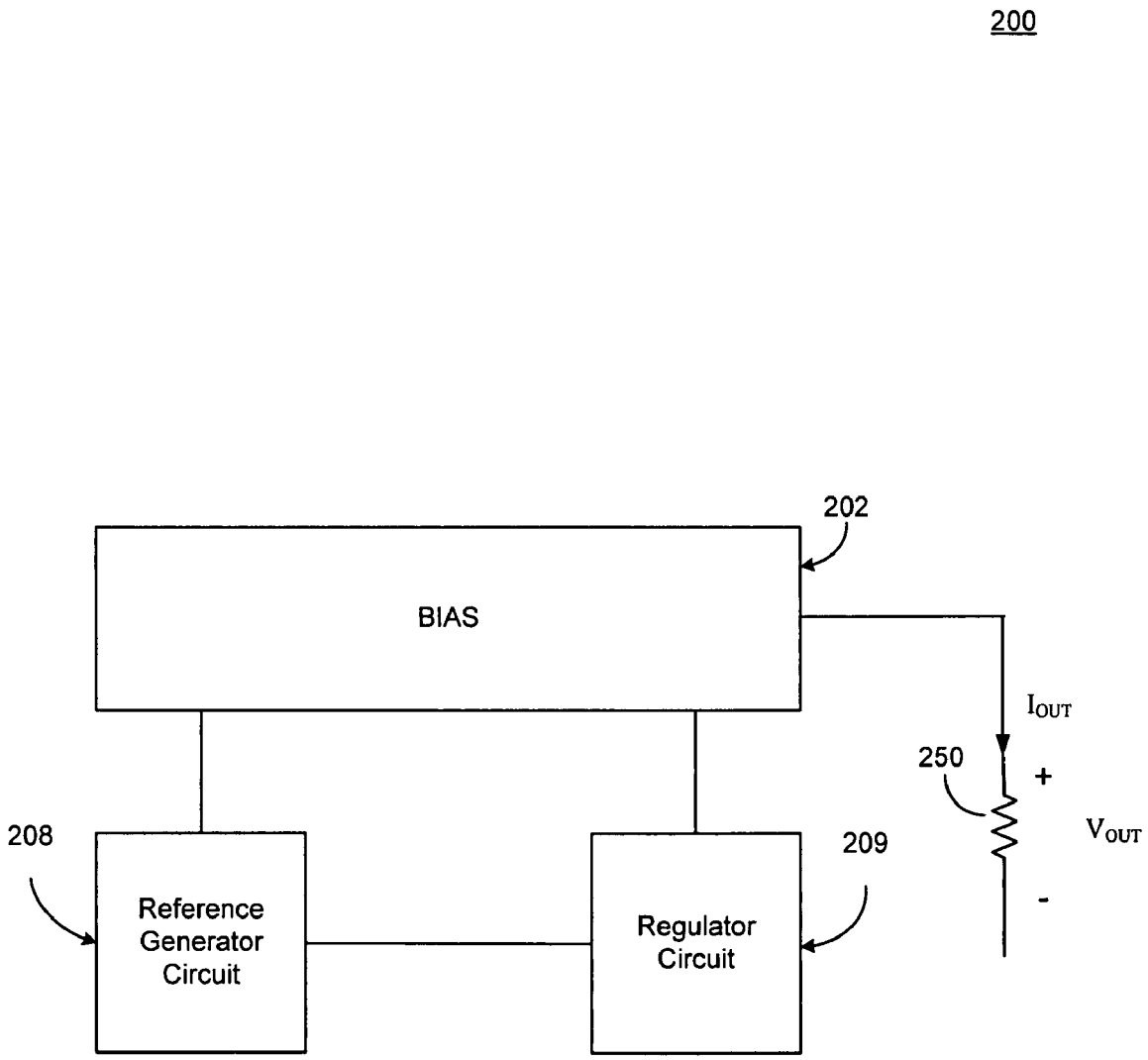
FIG. 2 is a generalized block diagram of one embodiment of a reference circuit constructed in accordance with the principles of the present invention.

A block diagram of one embodiment of a bandgap reference circuit 200 constructed in accordance with the principles of present invention is shown in FIG. 2. As shown, reference circuit 200 generally includes a bias circuit 202, a reference generator circuit 208 and regulation circuit 209. In operation, bias circuit 202 may be activated such that it provides current to reference generator circuit 208 and regulation circuit 209, turning reference circuit 200 ON. Such activation may be automatic based on a power connection or may be selectively enabled as desired.

After a startup period, reference circuit 200 reaches steady state and may operate as follows. Reference generation circuit 208 receives current from bias circuit 202 and provides one or more outputs (e.g., current) to regulator 209 that remain substantially constant over an extended temperature range. This is achieved through the use of various temperature compensation techniques described herein. Regulator 209 may compare or otherwise evaluate this signal with respect to a rail current or bias current provided by bias circuit 202 in order to generate a difference signal or other control signal that regulates the output of reference circuit 200.

This control signal may be used as a part of a feedback loop to regulate the output signal of regulator 200 (and/or to drive other components that produce an output signal which is equal or proportional to the output signal of reference generator circuit 208 with respect to a bias signal). This arrangement allows reference circuit 200 to maintain a constant output signal despite a poorly specified or fluctuating power source or bias signal.

In addition, regulator 209 may be configured to provide certain correction functions for circuitry in reference generator circuit 208. For example, as shown, reference generator circuit 208 may be constructed using one or more semiconductor devices such as bipolar transistors. Generating the substantially constant output signal described above may involve the use of components or networks in reference generator circuit 208 that experience voltage or current drops associated with operating conditions of such components. These changes may introduce errors to certain portions to circuit 208. Regulator 209 may be coupled with such circuitry to correct or otherwise compensate for such errors.

In certain embodiments, regulator circuit 209 may be configured as a buffer or other amplifier, with its output signal used as the output of reference 200 (not shown). In this case, the input signal to regulator 209 may or may not be compared to a bias or other power signal. Moreover, in such embodiments, the output of regulator 209 may not be provided to bias circuit 202 and may be used to directly drive other circuitry or components (e.g., such as external circuitry or other components).

In other embodiments, however, regulator 209 may provide its output to bias circuit 202, which may be used to drive bias circuitry and/or certain output circuitry to generate a substantially constant reference signal $I_{OUT}$ (discussed in more detail below). In such embodiments, bias circuitry and output circuitry may share a common drive signal which may result in the same or similar operating conditions of the circuits, allowing reference 200 to maintain a substantially constant output signal despite power supply fluctuation. Furthermore, reference circuit 200 may, in certain embodiments, include an optional precision resistor 250 if it is desired to generate a reference voltage $V_{OUT}$ based on $I_{OUT}$.

Figure 3:
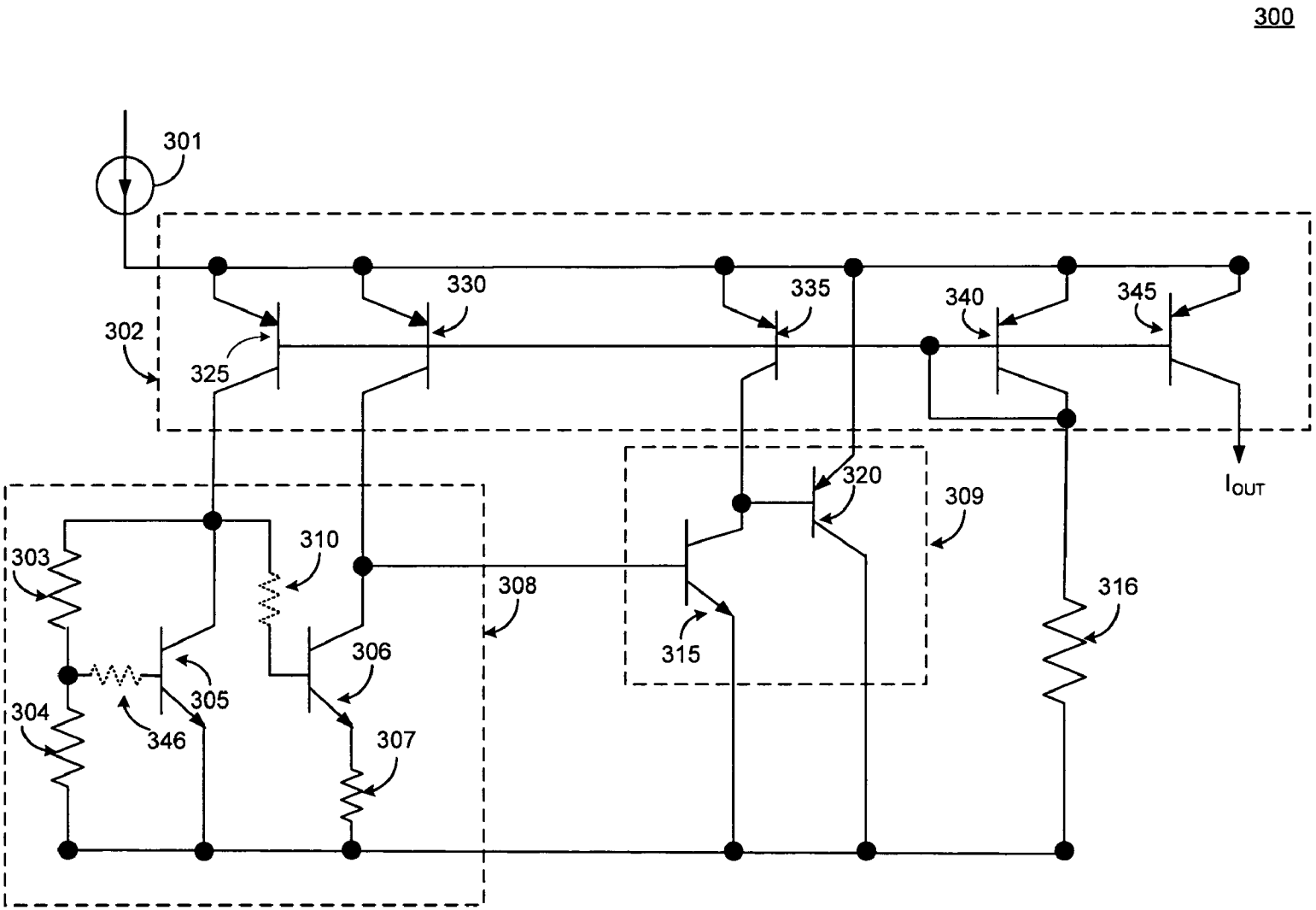
FIG. 3 is a schematic diagram of another embodiment of a reference circuit constructed in accordance with the principles of the present invention.

Referring now to FIG. 3, one possible specific implementation 300 constructed in accordance with the principles of the present invention is shown. Circuit 300 is similar in certain respects to the circuit described in FIG. 2 and generally includes components and functional blocks which have been numbered similarly to denote similar functionality and general correspondence. For example, circuit 300 includes a bias circuit 302 (bias circuit 202 in FIG. 2), a reference generator circuit 308 (reference circuit 208 in FIG. 2) and regulator circuit 309 (regulator 209 in FIG. 2).

As shown, bias circuit 302 may include PNP transistors 325, 330, 335, 340 and 345. In this example, the transistors are illustrated as bipolar junction transistors (BJTs), however, other suitable semiconductor devices, such as p-channel FETS, may be used if desired. In this embodiment, transistor 340 is depicted as a diode connected transistor, which is connected to ground through resistor 316, and is used as "start up circuitry" to begin conduction within circuit 300. However, other suitable start up circuitry may be used if desired. As shown, the bias transistors may be base connected to one another forming a current mirror and be of similar size. In other embodiments, however, transistor 325 may be somewhat larger than the others (e.g., four times larger in area) in order to provide additional current to portions of reference generator circuit 308.

In operation, when current source 301 is applied to the common emitter node of the PNP transistors in bias circuit 302, diode connected transistor 340 turns ON, and applies a drive signal to the common base of transistors 325, 330, 335 and 345 turning them ON. This turns bias circuit 302 ON, thus providing current to reference generator circuit 308 and regulator circuit 309, turning them ON as well. Because output transistor 345 is connected to the base of other transistors in bias circuit 302, its collector output will mirror the current provided by other similarly sized transistors in circuit 302.

As shown in FIG. 3, reference generator circuit 308 may include NPN transistors 305 and 306, resistors 303, 304 and 307. Generally speaking, transistors 305 and 306 operate such that they produce a substantially constant voltage at the emitter of transistor 306, which in turn generates a substantially constant current across resistor 307. As a result, the current flowing through PNP transistor 330 is regulated to substantially the same as the current flowing through transistor 306 (plus a base current correction factor). This causes the current flowing through transistor 345 to mirror the current developed across resistor 307, thus producing the substantially constant output current $I_{OUT}$ at its collector.

More specifically, reference generator circuit 308 operates as follows. Transistors 305 and 306 may be constructed such that there is a significant size difference between the two and thus a significant difference in their respective current densities (e.g., transistor 306 may be ten times the size of 305). This difference provides a component which is proportional to absolute temperature or exhibits a positive temperature coefficient. This may be represented by the difference in the base-emitter voltage of transistors 305 and 306 and may be expressed as equation (2):

$$\Delta V_{BE}=(kT/q)*\ln(J_1/J_2) \quad (2)$$

where k is Boltzmann's constant, T is the absolute temperature in degrees Kelvin, q is the electronic charge, $J_1$ is the current density of transistor 305, and $J_2$ is the current density of transistor 306.

Another portion of the reference generator circuit 308 may include an amplification component which may be constructed with NPN transistor 305 and resistors 303 and 304. This amplification portion may be constructed as a $V_{BE}$ multiplier based on the ratio of resistors 303 and 304 and the $V_{BE}$ Of transistor 305.

Thus, in operation, current provided to the collector of NPN transistor 305 causing its emitter-base voltage to be impressed across resistor 304. The current through resistor 304 flows through resistor 303, which generates a voltage across resistor 303 proportional to the ratio of resistor 303 to resistor 304 and the $V_{BE}$ of NPN transistor 305. As shown, this voltage is applied to the base of transistor 306 and thus the resultant voltage across resistor 307 is a combination of the $V_{BE}$ voltage of transistor 306 plus the difference in emitter-base voltage due to the area ratio of transistor 305 to transistor 306. The current in the collector of NPN transistor 306 is thus equal to the current flow in its emitter minus its base current.

With this configuration, if the value of resistor 303 is selected properly using known techniques (e.g., in view of the area ratio of transistors 303 and 304) the voltage across resistor 307 will remain constant over an extended temperature range. As explained above, transistors 305 and 306 do not operate with a fixed current density ratio as temperature changes. Transistor 305 operates at substantially the same current as transistor 325 minus the current flow through resistors 303 and 304. This decrease in current (which is proportional to $V_{BE}$) varies with temperature (as does the current through the resistors) and thus provides compensation for second order errors (sometimes referred to as "curvature compensation"). If desired, the amount of compensation provided can be altered by adjusting the proportion of current flowing through resistors 303 and 304 compared to the current flowing through transistor 305.

Because the voltage across resistor 307 is substantially constant, the current through resistor 307 is substantially constant as well. However, the current at the collector of transistor 306 is lower than the current at its emitter by the value of its base current. As a result, the current drawn from transistor 330 by transistor 306 does not fully reflect the current in resistor 307 and therefore introduces an error factor into reference circuit 300.

This error factor may be corrected by coupling the base of transistor 315 in regulator circuit 309 to the collector of transistor 306. If transistors 306 and 315 are constructed such that they are substantially the same size, and operate at substantially the same current, the base current missing from the collector of transistor 306 may be added into the circuit by transistor 315. With this correction, the current drawn from transistor 330 is substantially equal to the current through resistor 307. This causes current mirrored to transistor 345 from transistor 306 to be substantially equal to the current in resistor 307.

As shown in FIG. 3, regulator circuit 309 may include NPN transistor 315 and PNP transistor 320. In operation, this circuit may act as a feedback loop with transistor 315 driving the base of transistor 320 as a shunt regulator to maintain the current of transistor 330 substantially equal to the current at the collector of transistor 306. As a result, the mirror current through transistors 325, 335, 340 and 345 also remain substantially constant with temperature variation. The current through the mirror in bias circuit 302 is varied to match the current in transistor 330 because the current in resistor 316 varies due the voltage across the regulation loop. Regulator 309 may also establish the voltage at the collector of transistor 306. In this way, reference 300 provides a robust rejection of bias fluctuation and provides an output current that is substantially constant over an extended temperature range.

In some implementations of the present invention, it may be desirable to trim certain components to ensure that the output current of reference 300 is within acceptable tolerances. In this case, it may be desirable at some point in the manufacturing process and test reference 300, and if necessary, trim the value of resistor 307 to ensure output accuracy or establish a desired current value. Furthermore, trimming resistor 307 to set the output current in feedback loop created by regulator circuit 309 also changes the current in transistors 305 and 306. This change in current as a function of trimming resistor 307 helps keep the transistors operating at approximately the same current density so that trimming the output current has a minimal effect on temperature coefficient of reference 300.

An additional advantage of reference 300 is that transistors 325, 330, and 335 may operate at substantially the same collector voltage. Because transistors 325 and 330 operate at substantially the same collector to base voltage, better matching is achieved. Moreover, if the collector of transistor 345 is used to drive a resistor to ground to obtain a constant output voltage, then the collector to base voltage of transistors 330 and 345 are also approximately equal. It will be appreciated that although transistor 345 is depicted as part of bias circuit 202, that its primary function is to provide output current for reference 300 and thus may be viewed as an output circuit.

Furthermore, in some embodiments, it may desirable to introduce additional components to reduce or eliminate certain undesirable effects associated with process variations such as variation of transistor base width which may cause changes in certain conduction characteristics such as current gain (beta values) and/or $V_{BE}$. One way this may be accomplished is by the introduction of optional resistor 310 (shown in dotted lines) between the collector of transistor 305 and the base of transistor 306. If the proper value of optional resistor 310 is obtained, the effects of beta variation may be minimized or substantially cancelled. This, however, may require trimming resistor 310 (or precision fabrication).

The beta variation mentioned above with respect to transistors 305 and 306 also results in changes to their $V_{BE}$. Moreover, the base current of transistor 305 flows through the resistance of its associated bias network (e.g., the parallel resistance of resistors 303 and 304) adding a temperature drift component to the output current.

Changes in $V_{BE}$ alter the temperature drift of reference generator circuit 308. For many fabrication processes, the base current of an NPN transistor has a negative temperature coefficient (e.g., increasing as temperature decreases). The base current of transistor 305, and its associated temperature coefficient, may be used to minimize the changes in drift of reference generator 308 as beta varies with process. The change in temperature coefficient due to changes in $V_{BE}$ are opposite to changes in drift from the base current of transistor 305. Additional compensation may be obtained by adding an optional resistor 346 in series with the base of transistor 305.

Optional resistor 310 has the opposite effect on drift compared with the effects of the base current flow through resistors 303 and 304 as temperature varies. The addition of optional resistor 310 may cause the drift of reference generator circuit 308 to be substantially independent of beta or base current. However, changes in drift $V_{BE}$ to $V_{BE}$ variation shall occur. The base current of transistor 305 is substantially canceled by base current of transistor 306.

Figure 4:
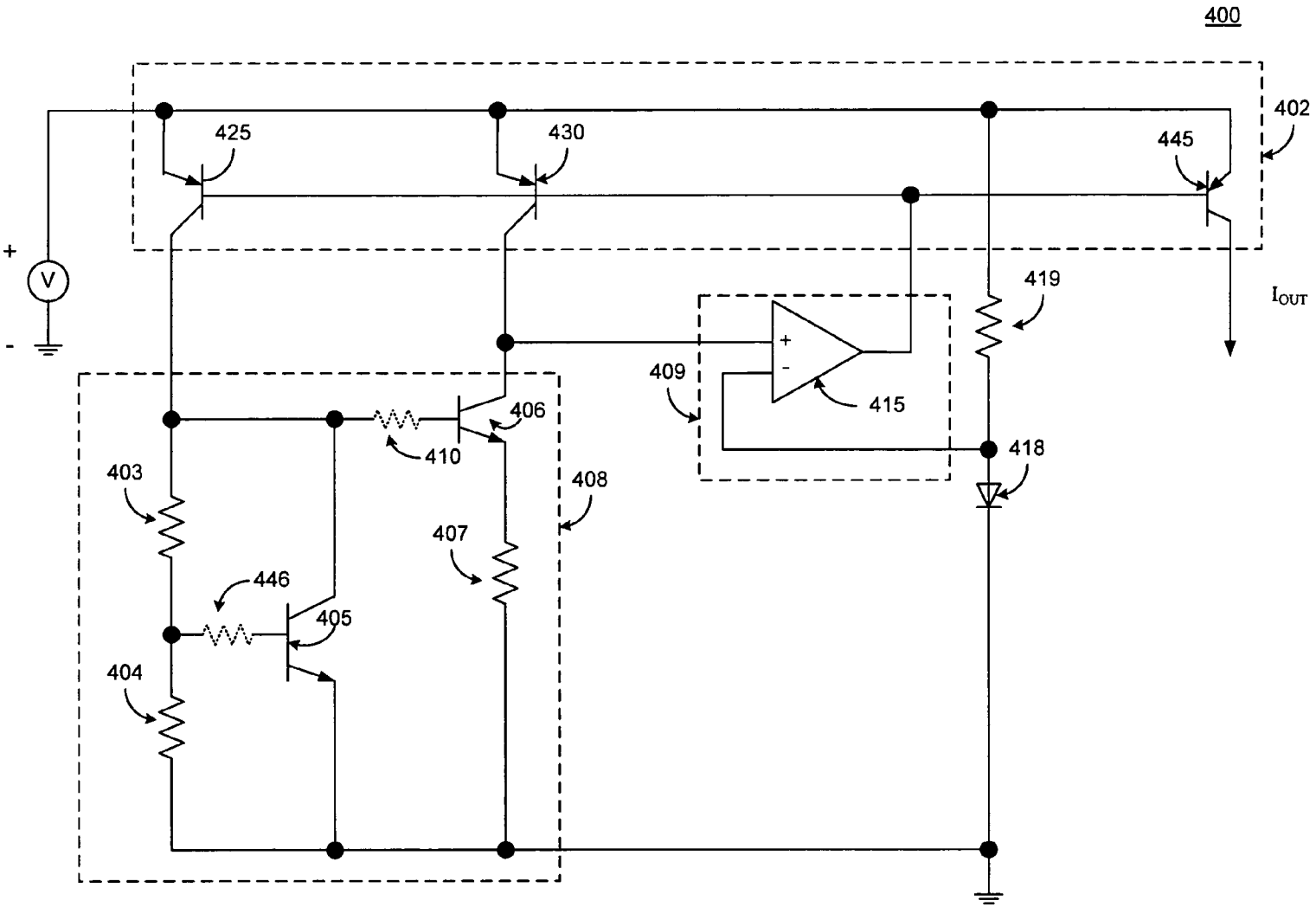
FIG. 4 is a diagram of another embodiment of a reference circuit constructed in accordance with the principles of the present invention.

Referring now to FIG. 4, another specific implementation 400 constructed in accordance with the principles of the present invention is shown. Circuit 400 is similar in many respects to the circuit described in FIG. 3 and generally includes components and functional blocks which have been numbered similarly to denote similar functionality and general correspondence. For example, circuit 400 includes a bias circuit 402 (bias circuit 302 in FIG. 3), a reference generator circuit 408 (reference circuit 308 in FIG. 3) and amplifier circuit 409 (amplifier 309 in FIG. 3).

As shown, reference 400 may operate in substantially the same way as reference 300, with the exception of amplifier circuit 409 and diode 418. In operation, diode 418 and resistor 419 may set a collector voltage on transistor 406 when a bias current is applied to its anode. Amplifier 415 drives bias circuit 402 to control the collector current of transistors 425, 430, and 445.

As shown, circuit 400 includes an amplifier circuit 409 and does not operate with the shunt topology shown in FIG. 3. With this arrangement, the output of reference generator circuit 408 is compared to the collector current of transistor 430 (at the non-inverting input of amplifier 415). Amplifier 415 compares the output of reference generator circuit 408 with the current provided by bias circuit 402. The difference between the collector current of transistors 406 and 430 is used in a feedback loop to regulate the current produced by bias circuit 402. This arrangement allows reference circuit 400 to maintain a constant output current with changes in supply voltage.

Figure 5:
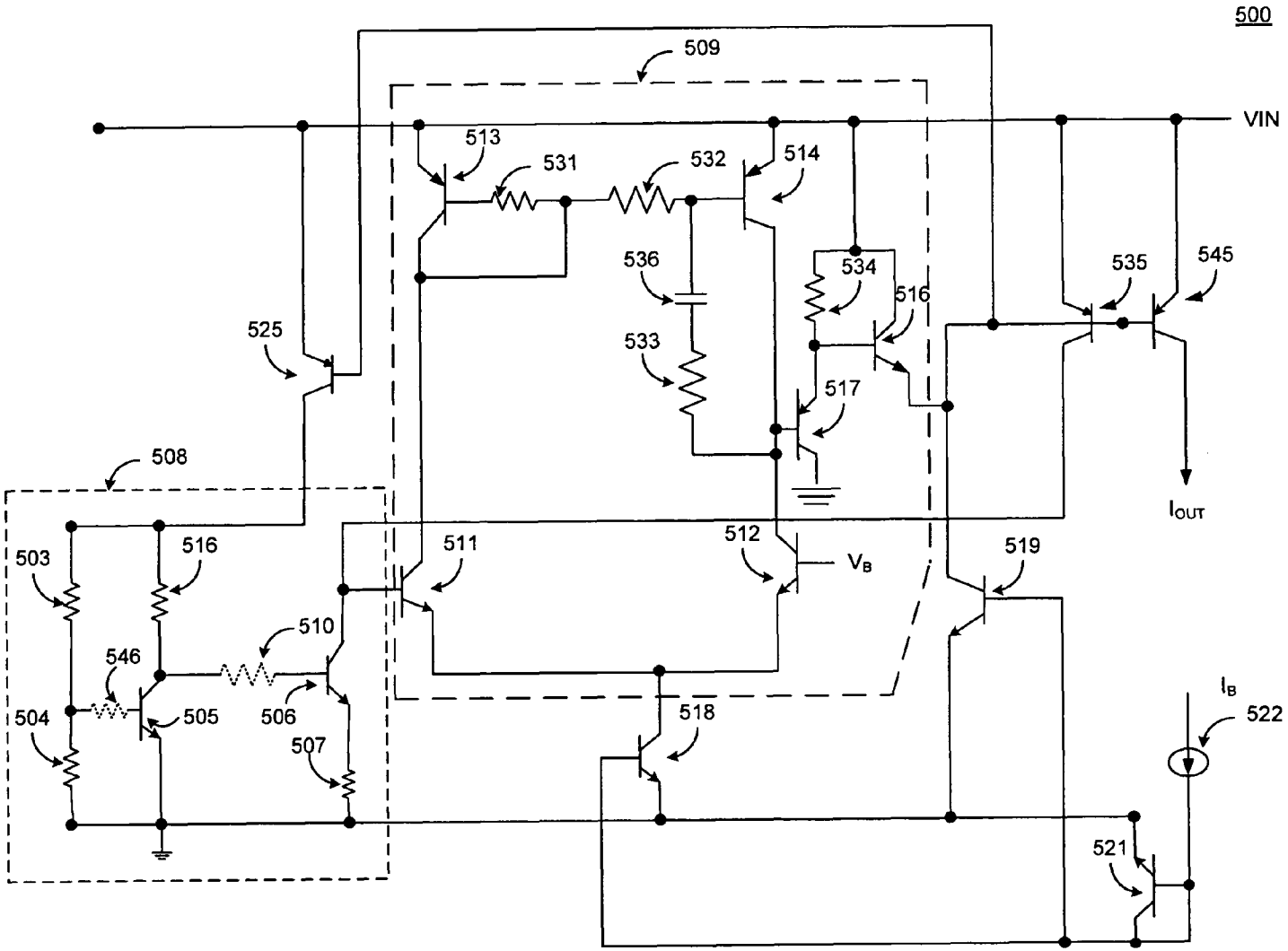
FIG. 5 is a more detailed schematic diagram of another embodiment of a reference circuit constructed in accordance with the principles of the present invention.

Referring now to FIG. 5, another specific implementation 500 constructed in accordance with the principles of the present invention is illustrated. Circuit 500 is similar in many respects to the circuit described in FIGS. 3 and 4 and generally includes components and functional blocks which have been numbered similarly to denote similar functionality and general correspondence. For example, circuit 500 includes a reference generator circuit 508 (reference circuit 308 in FIG. 3) and amplifier circuit 509 (amplifier 309 in FIG. 3).

As shown in FIG. 5, reference generator circuit 508 may include NPN transistors 505 and 506 and resistors 503, 504, 507, 510, 516 and 546. Similar to reference generator 308 of circuit 300, transistors 505 and 506 operate such that they produce a substantially constant voltage at the emitter of transistor 506, which in turn generates a substantially constant current across resistor 507. Amplifier circuit 509 matches the collector current of transistor 506 which is used to drive PNP transistors 535 and 545, which provides the substantially constant output current $I_{OUT}$ (discussed in more detail below).

More specifically, transistors 505 and 506 may be constructed such that there is a significant difference in their respective current densities (e.g., transistor 506 operates at a lower current density than transistor 505) which provides a component which is proportional to absolute temperature or exhibits a positive temperature coefficient.

In operation, current provided to the collector of transistor 505 causes its emitter-base voltage to be impressed across resistor 504. The current through resistor 504 flows through resistor 503, which generates a voltage across resistor 503 proportional to the ratio of resistor 503 to resistor 504 and the $V_{BE}$ of transistor 505. As shown, optional resistor 546 may be added if desired which causes an additional voltage drop but provides improved rejection in the case of bias current fluctuation (and may be added to circuits 308 and 408, if desired).

Thus, the resultant voltage across resistor 507 is the combination of the fractional $V_{BE}$ voltage of transistor 505 plus the difference in emitter-base voltage due to the area ratio of transistor 505 to transistor 506. The current in the collector of transistor 506 is equal to the current flow in the emitter minus its base current. Optional resistor 516 may also be added if desired to provide a more stable collector voltage in the case where the bias current varies somewhat.

With this configuration, if the value of resistor 503 is selected using known techniques, the voltage across resistor 507 will remain constant over an extended temperature range. As explained above, transistors 505 and 506 do not operate with a fixed current density ratio as temperature changes. Transistor 505 operates at substantially the same current as transistor 525 minus the current flow through resistors 503 and 504. This decrease in current (which is proportional $V_{BE}$) varies with temperature and thus provides compensation for second order errors. If desired, the amount of compensation provided can be altered by adjusting the proportion of current flowing through resistors 503 and 504 compared to the current flowing through transistor 505.

Because the voltage across resistor 507 is substantially constant, the current through resistor 507 is substantially constant as well. However, the current at the collector of transistor 506 is lower than the current at its emitter by the value of its base current. As a result, the current drawn from transistor 535 by transistor 506 does not fully reflect the current in resistor 507 and therefore introduces an error factor into reference circuit 500.

This error factor, however, may be corrected by coupling the base of transistor 511 in amplifier circuit 509 to the collector of transistor 506. If transistors 506 and 511 are constructed such that are substantially the same size, and operate at substantially the same current, the base current missing from the collector of transistor 506 may be added into the circuit by transistor 511. With this correction, the current drawn from transistor 535 is substantially equal to the current through resistor 507. Accordingly, current mirrored to transistor 545 from transistor 506 is substantially equal to the current in resistor 507.

As shown in FIG. 5, circuit 500 includes an amplifier circuit 509 with transistors 511-514, 516-517, resistors 531-534 and capacitor 536. In operation, transistors 511 and 512 (which may be the same or similar in size) receive inputs from a bias voltage VB and from the collector of transistor 506. Transistors 511 and 512 may form a differential amplifier (biased by diode connected transistors 513 and 514) which sets the voltage on the collector of transistor 506 substantially equal to the bias voltage applied at the base of transistor 512 (based on a single ended output at the collector of transistor 512).

Diode connected NPN transistor 516 drives the common base of PNP transistors 525, 535 and 545 (with respect to the emitter of transistor 517) such that the collector current of transistor 535 substantially matches the collector current for transistor 506. If transistors 506 and 511 run at approximately the same operating current, the base current of transistor 511 compensates for the loss of base current in transistor 506. This circuit regulates the currents through the PNP transistors 535 and 545 to provide a current $I_{OUT}$ that is substantially constant despite power supply and temperature changes. In some embodiments, for optimal regulation and accuracy of bandgap circuit 500, the voltage at the collector of transistor 545 should be about the same as the collector voltage on transistor 535.

Moreover, as shown in FIG. 5, voltage reference 500 may include the bias circuitry formed by NPN transistors 518, 519 and 521 along with current source 522. In operation, diode connected transistor 521 turns ON when current is provided from current source 522 and provides voltage to the base of transistors 518 and 519, turning them ON. These transistors act as bias circuitry to amplifier circuit 509 and set the operating range of reference 500.

It will be understood that unlike circuit 300, circuit 500 operates from a voltage source rather than a current source. The circuit shown in FIG. 3 is a shunt regulator driven by a current 301. Circuit 500 uses voltage source $V_{IN}$, and has regulation circuitry that effectively rejects supply variation.

Although preferred embodiments of the present invention have been disclosed with various circuits connected to other circuits, persons skilled in the art will appreciate that it may not be necessary for such connections to be direct and additional circuits may be interconnected between the shown connected circuits without departing from the spirit of the invention as shown. Persons skilled in the art also will appreciate that the present invention can be practiced by other than the specifically described embodiments. The described embodiments are presented for purposes of illustration and not of limitation, and the present invention is limited only by the claims which follow.

What is claimed is:

1. A bandgap reference circuit configured to provide a substantially constant output current, the bandgap reference circuit comprising:

a bandgap core circuit for generating a bandgap voltage, comprising:

a first transistor configured to run at a first predefined current;

a second transistor coupled to the first transistor to run at a second predefined current, wherein the first predefined current is substantially defined by the second predefined current minus a third predefined current and generated by the first transistor such that the second predefined current remains substantially constant as temperature varies;

an output circuit coupled to the bandgap core circuit to provide the substantially constant output current proportional to the second predefined current, and a regulator circuit coupled to the second transistor and the output circuit, and forming a feedback loop to control the substantially constant output current in accordance with the second predefined current.

2. The bandgap reference circuit of claim 1 wherein the third predefined current is defined, at least in part, by a bias impedance.

3. The bandgap reference circuit of claim 1 further comprising a third transistor coupled to the bandgap core circuit such that the current drawn by the third transistor provides a correction factor to the bandgap core circuit.

4. The bandgap reference circuit of claim 1 further including a first base impedance coupled to a base of the first transistor, the first base impedance reducing effects on temperature coefficient of process variation associated with physical implementation of the first transistor such that the output current of the bandgap core circuit remains substantially constant as temperature changes.

5. The bandgap reference circuit of claim 1 further comprising a second base impedance coupled to a base of the second transistor, the second base impedance reducing the effects of process variation associated with physical implementation of the second transistor such that a temperature coefficient of the output current of the bandgap core circuit is substantially independent of changes in current gain due to process variation.

6. The bandgap reference circuit of claim 1 further comprising an emitter impedance coupled to an emitter of the second transistor such that the output current of the output circuit is proportional to the current of the emitter impedance.

7. The bandgap reference circuit of claim 6 wherein the output current of the output circuit changes as the emitter impedance is varied.

8. The bandgap reference circuit of claim 6 wherein the output current of the output circuit may be established or made more precise by trimming the emitter impedance.

9. The bandgap reference circuit of claim 1 further comprising a regulator circuit coupled to the output circuit and the bandgap core circuit.

10. The bandgap reference circuit of claim 9 wherein the regulator circuit is configured as a shunt regulator.

11. The bandgap reference circuit of claim 9 wherein the regulator circuit is configured as a differential amplifier.

12. The bandgap reference circuit of claim 9 wherein the regulator circuit controls the output current of the output circuit to be proportional to the output current of the bandgap core circuit.

13. The bandgap reference circuit of claim 9 wherein the regulator circuit includes an amplifier and a feedback loop, the amplifier comparing the output current of the bandgap core circuit to a bias current and generating a difference signal based on the comparison, the difference signal controlling the output current of the output circuit such that the output current of the output circuit is substantially equal to the second predefined current.

14. The bandgap reference circuit of claim 9 wherein the regulator circuit includes an amplifier and a feedback loop, the amplifier comparing an output current of the bandgap core circuit to a bias voltage and generating a difference signal based on the comparison, the difference signal controlling the output current of a bias circuit coupled to the bandgap core circuit such that the output current of the bias circuit is substantially proportional to the second predefined current.

15. The bandgap reference circuit of claim 14 wherein the output current of the output circuit and the output current of the bias circuit are substantially equal.

16. A bandgap reference circuit configured to provide a substantially constant output current, the bandgap reference circuit comprising:

a bandgap core circuit for generating a bandgap voltage, comprising:

a first transistor configured to run at a first predefined current;

a second transistor coupled to the first transistor to run at a second predefined current, wherein the first predefined current is substantially defined by the second predefined current minus a third predefined current and generated by the first transistor such that the second predefined current remains substantially constant as temperature varies; and an output circuit coupled to the bandgap core circuit to provide the substantially constant output current proportional to the second predefined current, wherein a base of the third transistor is coupled to a collector of the second transistor such that the current drawn by the third transistor provides a correction factor that compensates for a base current loss introduced by the second transistor.

17. A bandgap reference circuit configured to provide a substantially constant output current, the bandgap reference circuit comprising:

a bandgap core circuit configured to generate a substantially constant current as temperature changes;

an output circuit coupled to the bandgap core circuit to provide the substantially constant output current of the bandgap reference circuit based on the current generated by the bandgap core circuit;

a regulator circuit coupled to the bandgap core circuit and the output circuit, the regulator circuit forming a feedback loop that controls the output current of the bandgap reference circuit to be substantially constant and proportional to the current generated by the bandgap core circuit.

18. The bandgap reference circuit of claim 17 wherein the regulator circuit is coupled to the bandgap core circuit such that the current drawn by the regulator circuit provides a correction factor to the bandgap core circuit.

19. The bandgap reference circuit of claim 17, wherein the bandgap core circuit further comprises:

a first transistor operating at a first predefined current; and a second transistor operating at a second predefined current, the first predefined current being substantially defined by the second predefined current minus a third predefined current.

20. The bandgap reference circuit of claim 19 further including a first base impedance coupled to a base of the first transistor, the first base impedance reducing effects of base width variation associated with physical implementation of the first transistor such that a temperature coefficient of the output current of the remains substantially constant with process variation.

21. The bandgap reference circuit of claim 19 further comprising an emitter impedance coupled to an emitter of the second transistor such that the output current of the output circuit is proportional to the current of the emitter impedance.

22. The bandgap reference circuit of claim 21 wherein the output current of the output circuit may be established or made more precise by trimming the emitter impedance.

23. A method of providing a substantially constant output current, the method comprising:

generating a first predefined current with a first transistor in a bandgap core circuit;

generating a second predefined current with a second transistor in a bandgap core circuit, wherein the first predefined current is substantially defined by the second predefined current minus a third predefined current and generated by the first transistor such that the second predefined current remains substantially constant as temperature varies;

providing the substantially constant output current with an output circuit based on the second predefined current; and providing a feedback loop between the second transistor and the output circuit to control the output current to be substantially constant and proportional to the second predefined current.

24. The method of claim 23 further comprising generating a third current through a third transistor to the bandgap core circuit such that the current drawn by the third transistor provides a correction factor to the bandgap core circuit.

25. The method of claim 24 further comprising generating a correction factor that substantially compensates for a base current error in the second transistor.

26. The method of claim 23 further comprising reducing effects of base width variation associated with physical implementation of the first transistor such that the temperature coefficient of the bandgap core circuit remains substantially constant as temperature changes.

27. The method of claim 23 wherein the output current of the output circuit is proportional to the current of the emitter impedance.

28. The method of claim 27 further comprising trimming the emitter impedance to establish or make more precise the output current of the output circuit.

29. The method of claim 27 further comprising comparing the output current of the bandgap core circuit to a bias current and generating a difference signal based on the comparison, the difference signal controlling the output current of the output circuit such that the output current of the output circuit is substantially equal to the second predefined current.

30. The method of claim 27 further comprising comparing an output current of the bandgap core circuit to a bias voltage and generating a difference signal based on the comparison, the difference signal controlling the output current of a bias circuit coupled to the bandgap core circuit such that the output current of the bias circuit is substantially proportional to the second predefined current.

31. The method of claim 23 further comprising reducing the effects of process variation associated with physical implementation of the second transistor such that a temperature coefficient of the output current of the bandgap core circuit is substantially independent of changes in current gain due to process variation.

32. The method of claim 23 further comprising controlling the output current of the output circuit to be proportional to the output current of the bandgap core circuit and to establish an output voltage of the bandgap core circuit.

* * * * *